US006027651A

United States Patent [19]

Cash

[11] Patent Number: 6,027,651

[45] Date of Patent: Feb. 22, 2000

[54] PROCESS FOR REGENERATING SPENT SOLVENT

[76] Inventor: Alan B. Cash, 4152 Kerwood Ct., San Diego, Calif. 92130

[21] Appl. No.: 09/178,056

[22] Filed: Oct. 26, 1998

Related U.S. Application Data

[63] Continuation-in-part of application No. 08/717,619, Sep. 20, 1996, abandoned, which is a continuation of application No. 08/254,540, Jun. 6, 1994, abandoned.

[51] Int. Cl.[7] ..... C02F 1/04; C02F 1/28

[52] U.S. Cl. ..... 210/662; 210/664; 210/739

[58] Field of Search ..... 210/739, 662, 210/664, 669, 689, 690, 799, 805, 96.1, 194

[56] References Cited

U.S. PATENT DOCUMENTS

| | | | |
|---|---|---|---|
| 2,067,345 | 1/1937 | Roberts et al. . | |
| 2,203,690 | 6/1940 | Malm et al. . | |
| 2,388,616 | 11/1945 | LaLande, Jr. . | |
| 2,556,248 | 6/1951 | Amick . | |
| 2,585,490 | 2/1952 | Olsen . | |
| 2,614,133 | 10/1952 | Ockert . | |
| 2,653,959 | 9/1953 | Moore et al. . | |
| 2,687,443 | 8/1954 | Douthitt . | |
| 2,709,674 | 5/1955 | Bergstrom . | |
| 2,973,312 | 2/1961 | Logan . | |
| 3,017,342 | 1/1962 | Bulat et al. . | |
| 3,072,567 | 1/1963 | Evans et al. . | |
| 3,231,324 | 1/1966 | Young . | |
| 3,309,166 | 3/1967 | Moncada . | |
| 3,610,260 | 10/1971 | Kearney . | |
| 3,617,561 | 11/1971 | Fanselow | 210/47 |
| 3,868,429 | 2/1975 | Faulkner . | |
| 3,931,350 | 1/1976 | Sparks . | |
| 4,040,866 | 8/1977 | Mondshine . | |
| 4,064,043 | 12/1977 | Kollman . | |
| 4,091,826 | 5/1978 | Baheke . | |
| 4,139,462 | 2/1979 | Sample, Jr. . | |
| 4,197,195 | 4/1980 | Ochsenfeld . | |
| 4,309,281 | 1/1982 | Dessau . | |
| 4,404,118 | 9/1983 | Herskovits . | |
| 4,406,796 | 9/1983 | Duval . | |
| 4,424,081 | 1/1984 | Giguere . | |
| 4,502,957 | 3/1985 | Jehle et al. . | |
| 4,508,851 | 4/1985 | Izumi et al. . | |
| 4,535,620 | 8/1985 | Cunningham | 73/23.1 |
| 4,606,774 | 8/1986 | Morris . | |
| 4,662,948 | 5/1987 | Weitzman . | |
| 4,747,937 | 5/1988 | Hilfman et al. . | |
| 4,753,735 | 6/1988 | Figiel . | |
| 4,774,004 | 9/1988 | Gruenewaelder et al. . | |
| 4,778,602 | 10/1988 | Allen, III | 210/502.1 |
| 4,793,931 | 12/1988 | Stevens et al. . | |
| 4,801,384 | 1/1989 | Steiner . | |
| 4,816,138 | 3/1989 | Visser et al. . | |
| 4,842,746 | 6/1989 | Fowler et al. . | |
| 4,857,150 | 8/1989 | Rival et al. . | |
| 4,879,888 | 11/1989 | Suissa . | |
| 4,954,222 | 9/1990 | Durr et al. . | |
| 4,960,520 | 10/1990 | Semmens | 210/640 |
| 5,011,542 | 4/1991 | Weil . | |
| 5,055,196 | 10/1991 | Darian et al. . | |

(List continued on next page.)

*Primary Examiner*—Cynthia L. Nessler
*Attorney, Agent, or Firm*—Nydegger & Associates

[57] ABSTRACT

A process for regenerating a solvent from a waste extract after use in a remediation process includes monitoring the water content and the amount of organic contaminants in the extract. If the water content in the extract is above a predetermined threshold value, the extract is distilled to yield the solvent therefrom for reuse in the remediation process. If the water content is below the threshold value but the amount of organic contaminants is above a predetermined limit, the extract is also distilled to yield the solvent therefrom for reuse. If the water content and amount of organic contaminants are both below their respective predetermined parameters, the extract is filtered through a molecular sieve to yield the solvent therefrom. The yield solvent is then collected from the distillation and filtering processes, and the regenerated solvent is then reused in the remediation process.

13 Claims, 3 Drawing Sheets

U.S. PATENT DOCUMENTS 5,069,755 12/1991 Durr et al. .
5,100,455 3/1992 Pinckard .
5,193,560 3/1993 Tanaka et al. .
5,203,998 4/1993 Benian .
5,223,144 6/1993 Woyciesjes et al. .
5,225,081 7/1993 Brownawell .
5,275,669 1/1994 Van Der Puy et al. .
5,340,406 8/1994 Fearon .
5,354,458 10/1994 Wang et al. ..... 210/180
5,422,330 6/1995 Kaylor ..... 502/402
5,434,332 7/1995 Cash .
5,453,133 9/1995 Sparks et al. .

PROCESS FOR REGENERATING SPENT SOLVENT

This application is a continuation-in-part of application Ser. No. 08/717,619 filed Sep. 20, 1996, which is now abandoned, and which is a File Wrapper Continuation of application Ser. No. 08/254,540 filed Jun. 6, 1994, which is now abandoned.

FIELD OF THE INVENTION

This invention relates in general to extraction processes and in particular to a purification process for solvents. More specifically, this invention relates to a novel low cost method of removing organic contaminants from an organic solvent stream using a molecular sieve/molecular absorber so that the organic solvent can be reused in a solvent extraction process or other process requiring solvent regeneration and the contaminants are concentrated for disposal.

BACKGROUND OF THE INVENTION

Heretofore, solvent extraction systems for removing organic contaminants from soil, sediment, sludges and debris have used distillation systems to purify the organic solvent process fluids. The organic solvents used in these systems are typically volatile, while the contaminants in the solvents are semi-volatile to non-volatile. During the distillation process, the volatile solvents are removed from the distillation column, and the semi-volatile and non-volatile contaminants are concentrated as still bottoms. The volatile solvent is condensed after leaving the distillation column and is reused in the system to extract more contaminants from soil. The still bottoms with the concentrated contaminants are removed and are typically shipped off-site for destruction at an approved facility.

The solvents used in these systems to dissolve the organic contaminants vary widely. They are selected for their ability to dissolve the contaminant of interest, usually have lower toxicity than the contaminant, and can be separated from the target contaminant by distillation. Because of the energy usage in distilling and condensing the solvent, compounds with low latent heat values are selected in order to minimize energy usage.

The contaminants collected by these systems include Polychlorinated Biphenyls (PCBs), chlorinated dioxins, chlorinated furans, chlorinated pesticides, chlorinated herbicides, wood preservatives, and other organic compounds. Nonvolatile compounds are most often processed by solvent extraction systems as these contaminants have no low cost remedial alternatives.

The distillation process has been successful in separation of contaminants from the solvent streams, and solvent extraction processes have been used to clean United States superfund sites and other contaminated sites throughout the world. Distillation systems, do, however, have several serious problems.

Distillation systems use large amounts of energy to volatilize the solvent, and also large amounts of energy to condense the solvent. Because of the heat involved, and the fact that many of the solvents used in solvent extraction systems are flammable, safeguarding the system to operate in an explosive proof manner is a large expense. The capital cost of distillation systems is also expensive. A full scale solvent extraction system may have a $1,000,000 distillation system. Due to the large capital expense, the size of the systems can not be altered to fit the individual site size, rather, sites have to be found that are in the size range of the distillation unit.

Distillation systems also require continuous monitoring, which drives the instrumentation and labor costs upwards.

Because of the high capital costs, energy costs, and labor costs associated with distillation units, solvent extraction companies have focused on large superfund type sites. Sites smaller than 10,000 tons have usually not been addressed by solvent extraction systems. Current solvent extraction methods using distillation have need for improved solvent purification systems that will lower capital costs, energy costs, and labor costs so that small and large contaminated sites can be processed with this technology.

SUMMARY AND OBJECTS OF THE INVENTION

In view of the foregoing limitations and shortcomings of prior art devices as well as other disadvantages not specifically mentioned above, it is apparent that a need exists in the art for a low cost and highly effective method or removing organic contaminants from the solvent in solvent extraction systems.

It is therefore an object of this invention to fulfill that need by providing a process for removing organic contaminants from solvent that is cost effective, safe to operate, has low capital costs, low energy consumption, and low labor costs to operate.

Another object of this invention is a process that can be quickly adapted to the size of the site to be processed, instead finding sites to fit the distillation capacity.

A further object of this invention is a process that can be used to pre-concentrate an organic waste stream so that the distillation capacity of any system can be inexpensively increased.

A further object of this invention is a process that is easy to transport and set-up.

A further object of this invention is a process that requires little training to operate.

A further object of this invention is a process that can be used to separate contaminants with boiling points close to that of the extracting solvent.

A further object of this invention is a process which can allow blending of solvents with similar or non-similar boiling points and vapor pressures, allowing a wider variety of extraction fluids.

A further object of this invention is a process that is not affected by the water content of the solvent, as water is a natural component of soil.

A further object of this invention is a process that is safer to operate than systems with distillation.

A further object of this invention is a process that creates a safer concentrate of contaminants for shipping.

A further object of this invention is a process which uses no heat in the solvent/contaminant separation process, as heat can cause other unwanted components to form.

A further object of this invention is a process in which the equipment necessary can be delivered without long fabrication delays.

It is another object of the present invention to provide a cost effective method for regenerating spent solvents which relies on alternatively selecting distillation or filtration as the means for withdrawing contaminants from a soil remediation extract. More specifically, by first determining whether water content levels are high or low in the extract, and by then selectively determining whether contaminant levels are high or low in the extract, only the high water level and high contaminant level extracts need to be processed by the more expensive distillation methods.

These objects and other objects not specifically mentioned above are accomplished in accordance with preferred embodiments of the present invention by the use of selected solvents with molecular sieve/molecular absorbent materials for removing organic contaminants from the solvents.

BRIEF DESCRIPTION OF THE DRAWINGS

A preferred embodiment of the invention is illustrated and describe in the accompanying drawings wherein like numbers refer to like parts and in which.

DESCRIPTION OF INVENTION

Figure 1:
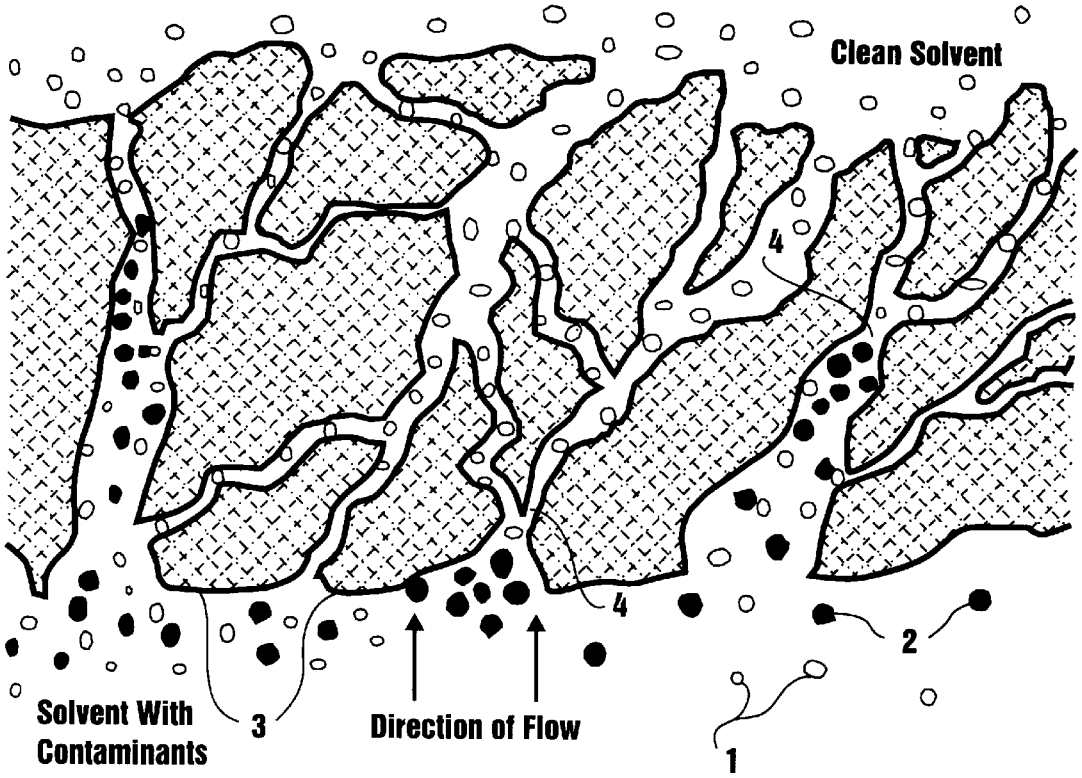
FIG. 1 is a schematic. representation of a molecular sieve/molecular absorbent preferentially concentrating contaminants and allowing solvent to pass.

FIG. 1 is a schematic representation of using a molecular sieve/molecular absorbent 3 to separate clean solvent from contaminants within the solvent for solvent extraction systems. Because of molecular size or shape, some compounds 1 will migrate through a molecular sieve/molecular absorber, while other compounds 2 will be trapped in constriction areas in pore throats 4 or along various surfaces. If the compounds that can migrate through a molecular sieve/molecular absorber are selected as the carrier solvent for contaminant compounds that do not migrate as well through the molecular sieve/molecular absorber, then a separation of carrier solvent from contaminants will occur when the contaminated solvent is moved in one direction through the molecular sieve/ molecular absorber.

In current practice, many of the contaminant compounds that are within the solvent to be regenerated have molecular weights far in excess of the carrying solvents. Contaminants that can be easily removed from compatible solvent streams with the molecular sieve/molecular absorber include but are not limited to Polychlorinated Biphenyls (PCBs), chlorinated pesticides such as Aldrin, BHC, Chlordane, DDD, DDE, DDT, Dieldrin, Endosulfan, Endrin, Endrin aldehyde, Heptachlor, Heptachlor epoxide, Lindane, Methoxychlor, and Toxaphene, chlorinated herbicides such as 2,4-D, 2,4, 5-T, and agent orange, wood preservatives such as pentachlorophenol, creosote, and other phenols, chlorinated dioxins, chlorinated furans, and coal gasification plant contaminants such as polycyclic aromatic hydrocarbons (PAHs).

Solvents that can migrate through molecular sieves/ molecular absorbers, and thus be used as carrier solvents include but are not limited to Acetaldehyde, Acetic Acid, Acetone, Acetonitrile, Acetylene, Acrolein, Amines, Ammonia, Butadiene, Butane, n-Butane, tert-Butyl Alcohol, Butylene, Carbon dioxide, Carbon monoxide, Dichloromonofluoromethane (Freon 21), Dimethyl sulfide, Ethane, Ether, Ethyl alcohol, Ethyl Chloride, Ethyl formate, Ethyl mercaptan, Ethylene, Ethylene oxide, Formaldehyde, Formic Acid, Freon 11 5, Hexane, Hexene, Hexyne, Isopropyl alcohol, Methane, Methyl acetate, Methyl alcohol, Methyl bromide, Methyl chloride, Methyl ether, Methyl formate, Methyl mercaptan, Nitromethane, Pentane, Pentylene, Pentyne, Phosgene, Propionaldehyde, Propane, Triethylamine, and Vinyl Chloride.

Molecular sieves/molecular absorbers that can be used include but are not limited to activated granular carbon (AGC), zeolites, peat moss and other biomasses, and synthetic plastic molecular sieves.

Figure 2:
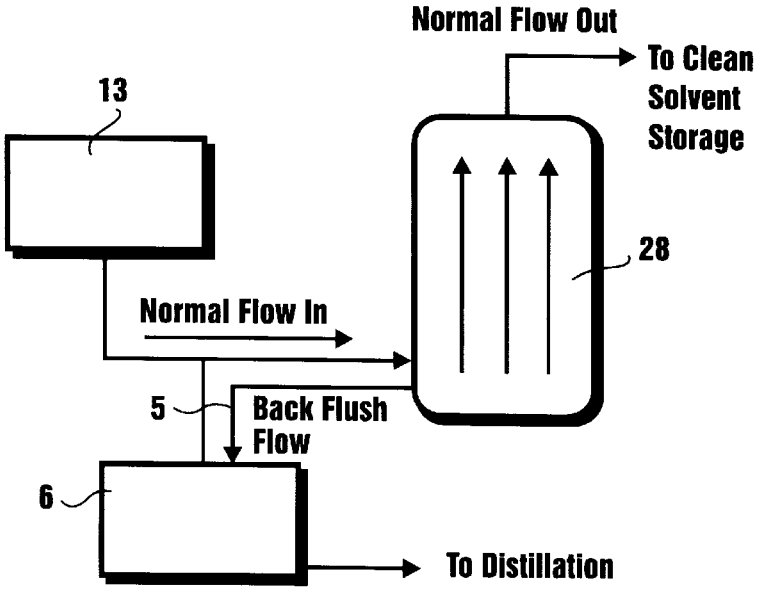
FIG. 2 is a schematic representation of a first alternative embodiment of the present invention.

FIG. 2 is a schematic representation of a second preferred embodiment of the present invention. The contaminated solvent within the contaminated solvent holding vessel 13 is pumped into the molecular sieve/molecular absorbent vessel 28 where it flows through the molecular sieve/molecular absorbent 3. Clean solvent will pass out of the molecular sieve/molecular absorbent 3 and can be reused in the system. After a period of time, which is variable dependent upon the incoming contaminant types and concentration levels, the molecular sieve/molecular absorbent is flushed with clean solvent in the opposite direction of normal flow. This dislodges contaminant in great volumes 5 which is back flushed into a back flush holding vessel 6. The heavily contaminated concentrate can be disposed of directly, or can be further processed by distillation for additional waste volume reduction. This procedure adds additional life to the molecular sieve/molecular absorber, and can greatly reduce the amount of distillation volume necessary for system processing.

Figure 3:
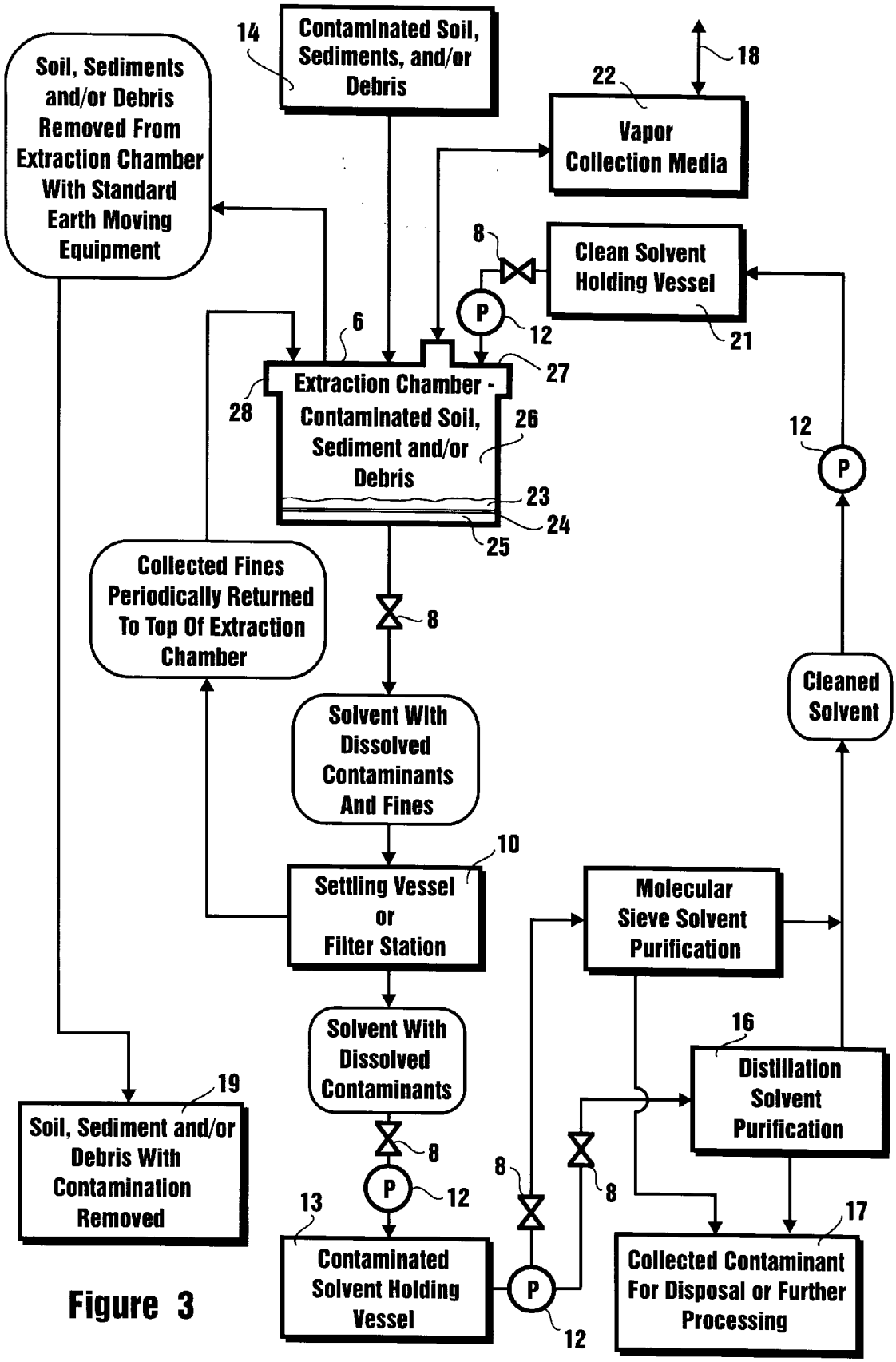
FIG. 3 is a schematic representation of a second alternative embodiment of the present invention.

FIG. 3 is a schematic representation of a solvent extraction system using a third preferred embodiment of the present invention. At highly contaminated sites, a distillation system is used to remove the contaminant from the solvent in the first few cycles of the solvent through the extraction vessel. After initial contamination has dropped, then the contaminated solvent is cleaned by a molecular sieve/ molecular absorbed 28. The use of distillation initially followed by the use of the molecular sieve/molecular absorbent is called a split system, and results in significant economic savings over the use of distillation alone. High contaminant concentrations can be first treated with distillation, then the low contaminant concentrations can be treated with the molecular sieve/molecular absorbent. The split system configuration is the second alternative embodiment of the present invention.

In full explanation of the diagram, starting with a pile of excavated soil/sediment/debris 14, the soil is moved by any earth moving technique including but not limited to front end loaders, augers, conveyor belts, and backhoes into the extraction chamber 26. The extraction chamber can be any size or shape of vessel that will contain the solvent without reacting with the solvent. Examples of extraction chambers include but are not limited to fiberglass, high density plastics, stainless steel and concrete vessels which can be used for many organic solvents and surfactants, while fiberglass, glass, and stainless steel can be used for many acid and base solvents. The vessels can be above ground, or in ground, transportable or fixed. The extraction chamber will use a removable top cover impermeable and nonreactive to the solvent vapors if these vapors cause a threat to human health or the environment. Examples of these covers include but are not limited to plastic sheets, stainless steel lids, glass lids, fiberglass lids, and flexible rubber sheets. If the removable to piece is used, a vent in the piece allows air or alternately, non-flammable gasses, to enter and exit the extraction chamber. The air to and from the extraction chamber passes through a porous and permeable vapor collection media 22 to stop vapors from escaping to the atmosphere. Examples of the porous and permeable vapor collection media include but are not limited to water bubblers, activated carbon, and molecular sieve/molecular absorbents.

The removable top piece 27 is attached to the extraction chamber 26 at the top seating area 28. This sealing area can be but is not limited to rubber gaskets, bolt down mechanisms, shock cords or soft putty. Within the Extraction Chamber 26 the bottom is lined with a highly porous and permeable media 25 that will support the filter 24 and will serve as a collection area for leachate. Examples of highly porous and permeable media 25 include but are not limited to pebbles, marbles, plastic beads, and plastic netting. The filter 24 can be a solid sheet or layers of sheets covering the highly porous and permeable media 25. The filter should be compatible with the contaminants in the soils, sediments, and debris and also compatible with the solvent selected. The filter should also allow the free movement of fluids and vapors, but should retard fine particles. Examples of the filter 24 include but are not limited to reinforced filter paper, non-woven geotextiles, and fine netting. Above the filter 24 a fine sand 23 holds the filter in place, serves to collect formation fines that are mobilized during the leaching, and prevents premature loading of the filter 24. The contaminated soil, sediment, and debris to be leached is placed directly on the clean fine sand.

After leaching, the cleaned soil, sediments, and debris is removed from the extraction chamber with standard earth moving equipment for either reuse at the site, transportation offset, or for further treatment 19. Contaminated solvent from the leaching process is removed from the highly porous and permeable media 25 by either gravity drainage or by pump through rigid or flexible pipes to a settling vessel or filter station 10. This settling vessel or filter station removes any suspended solids from the contaminated leachate that may have come from the extraction chamber. Examples of settling vessels or filter stations include but are not limited to tower clarifiers, flocculation tanks, sand filters, bag filters, and cartridge filters. Collected fines from the settling vessel or filter stations can be returned periodically to the top of the soils, sediments, and debris in the extraction chamber by any method including but not limited to hand carrying, augers and belts.

Contaminated solvent from the settling vessel or filter station 10 is gravity fed or pumped to the contaminated solvent holding vessel 13. This vessel should be compatible with both the collected contaminant and the solvent selected for use at the site.

The collected contaminant is placed in vessels 17 for disposal or further processing. The clean solvent is either gravity fed or pumped through rigid for flexible pipe to the clean solvent holding vessel 21. The clean solvent holding vessel should be constructed of materials compatible with the solvent selected. The clean solvent from this vessel is then gravity fed or pumped to the extraction chamber 26.

Figure 4:
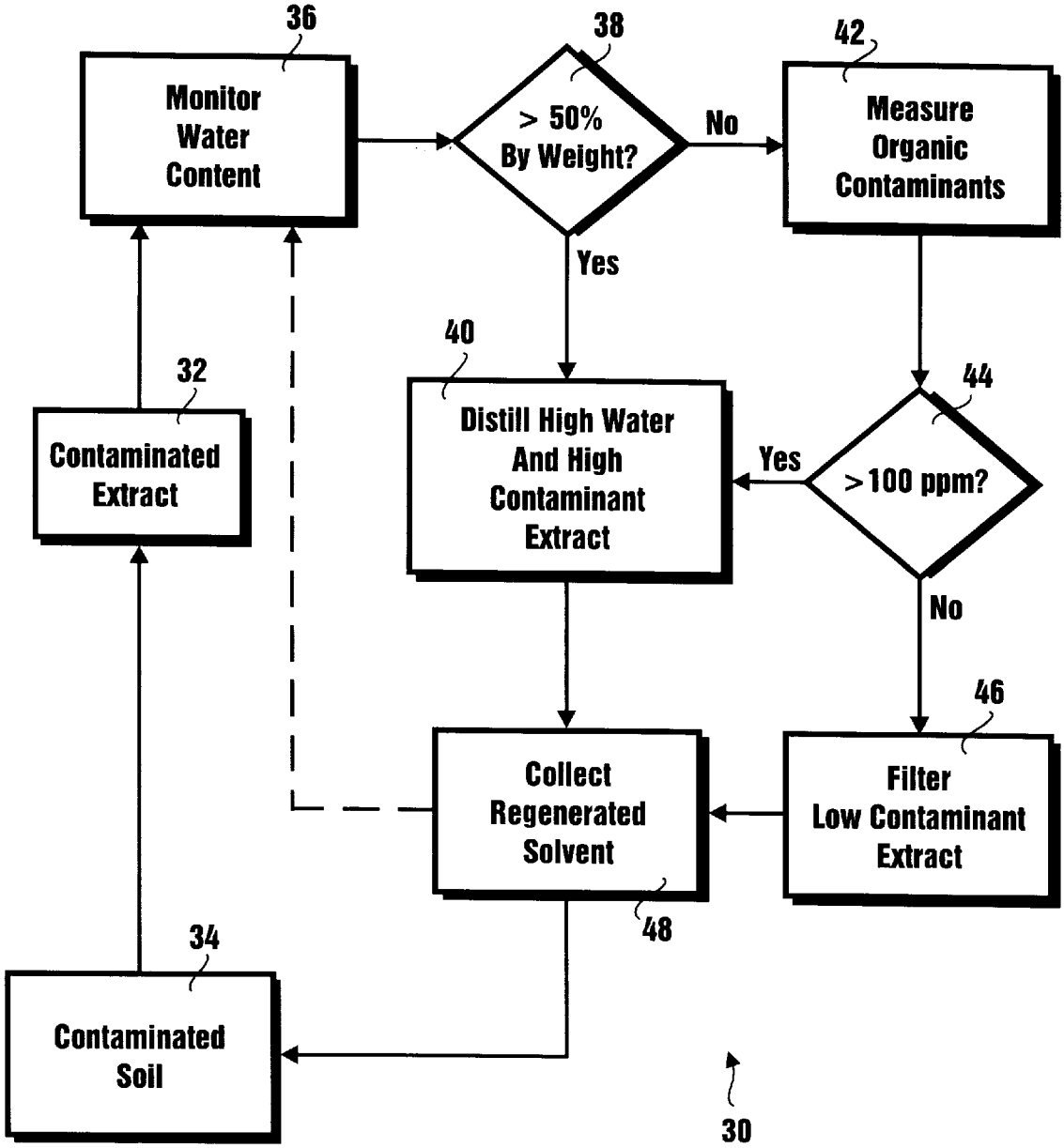
FIG. 4 is a logic flow chart of the steps used in practicing the methods of the present invention.

Referring now to FIG. 4, a method in accordance with the present invention is shown as a logic flow chart and is generally designated 30. To begin, as indicated by box 32, the contaminated solvent extract which has been generated during the remediation process is collected. Typically, the remediated material is contaminated soil (box 34) and the extract contains organic contaminants and water which have been removed from the remediated material and are dissolved in the extract. Next, as indicated by box 36 in FIG. 4, the water content of the contaminated extract is monitored. In the preferred embodiment of the invention, the water content of the contaminated extract is monitored by a hydrometer (not shown) of a type well known in the pertinent art. The extract's water content is then compared to a predetermined threshold value, as shown by decision box 38. It is typical that the water content of the extract will initially be in a range of between zero and eighty percent water by weight of contaminated extract. Accordingly, the predetermined threshold value for water content can be chosen from this range by the operator and, preferably, will be approximately fifty percent (50%) by weight of the extract.

As indicated by the decision block 38 in FIG. 4, if the percentage of water in the contaminated extract is greater than the threshold value (e.g. 50%), the contaminated extract is deemed to be a high water level extract. If the percentage of water in the extract is less than the threshold value, however, then the extract is a low water level extract. For low water level extracts, the amount of organic contaminants is then measured as indicated by box 42 in FIG. 4. Preferably, the measurement indicated by box 42 is done by a gas chromatograph (not shown) in a manner well known by the skilled artisan. It is to be appreciated by the skilled artisan, however, that a gas chromatograph can measure any one or a combination of organic contaminants such as those listed above in the discussion of FIG. 1. It will most likely happen, however, that most of the contaminants present of concern will be PCBs, chlorinated pesticides, and other chlorinated hydrocarbon contaminants.

Once the amount of organic contaminants in the low water level extract has been determined, the amount is compared to a predetermined limit, as indicated by decision box 44. As shown, this predetermined limit should be somewhere around one hundred parts per million (100 ppm) of organic contaminants. It is to be appreciated by the skilled artisan, however, that the predetermined limit is dependent on the organic contaminants that are to be monitored.

In accordance with the decision box 44 shown in FIG. 4, if the amount of organic contaminants in the low water extract is greater than the predetermined limit, the low water extract is reclassified and is thereafter considered a high contaminant extract. On the other hand, if the amount of organic contaminants in the low water level extract is less than the predetermined limit indicated in decision box 44, the extract is deemed to be a low contaminant extract.

By considering block 40 in combination with the decision blocks 38 and 44, it will be seen that both the high water level extract and the high contaminant level extract are the be distilled (block 40). A low contaminant level extract, however, is to be filtered (block 46). In either case, the regenerated solvent which results from distillation (block 40) or filtration (block 46) is collected for further use (block 48). One use for the collected solvent will be for futher remediation projects. It may, however, be necessary that the regenerated solvent be diverted to repeat the regeneration process of the present invention for further purification. This diversion of regenerated solvent is indicated by the dotted line between box 48 and box 36 in FIG. 4.

Although many different filters can be used, the filtering step of the method of the present invention is preferably accomplished using a molecular sieve. When a molecular sieve is used, the lighter molecular weight solvent and water can pass through the sieve, but the sieve traps the heavier molecular weight contaminants (See FIG. 1). In the preferred embodiment of the invention, the molecular sieve is made of a material of activated granular carbon (AGC). Alternatively, a zeolite or peat moss material can be used for the sieve or synthetic filter sheeting, such as nylon, Teflon, and polypropolene. In any case, for the molecular sieve to properly accomplish the filtering step indicated by box 46, a large difference in the molecular weights of the solvent the molecular weight of the primary organic contaminants is desired. For example, and in the preferred embodiment of the invention, isopropyl alcohol with a molecular weight of substantially sixty grams per mole (60 g/mole) is used to filter PCB's and other chlorinated hydrocarbons which have a minimum molecular weight of two hundred and twenty-five grams per mole (225 g/mole). With this order of magnitude of difference between the molecular weights of the the respective solvent and contaminant, the sieve can be very effective at removing the contaminants.

SUMMARY, RAMIFICATIONS, AND SCOPE

Accordingly, the reader will see that the use of the molecular sieve/molecular absorbent for removing organic contaminants from the solvent can be successfully implemented for solvent extraction systems. This system will decrease the overall capital costs of solvent extraction systems, allowing this remedial technology to be used more economically.

Further advantages include:

Molecular sieve/molecular absorbents can reduce contaminant levels in the solvent to very low levels. This makes the solvent more effective as a removal agent, especially when removing very low concentrations of contaminants. In tests performed by the US EPA Superfund Innovative Technology Evaluation (SITE) program with the author, Isopropyl Alcohol was used as the extraction solvent to remove PCBs from soil and debris. The contaminated solvent contained up to 5,000,000 parts per billion (ppb) Aroclor 1260 (a type of PCB). After one pass through a Activated Granular Carbon (AGC) filter drum (the molecular sieve/molecular absorbent used in this case), the PCB content of the solvent was below the detection limit of the test, 1 ppb. This is a reduction of 99.99998 percent.

The use of Activated Granular Carbon (AGC) as a molecular sieve/molecular absorbent has been used for the separation of organic contaminants from water successfully, and this technology is widely available in a variety of containers. AGC has not been used to separate solvents other than water from other organics prior to the use by the Author. Certain compounds are "transparent" to AGC, and these can be used as extraction solvents for the solvent extraction system. These extraction solvents include alcohols, low molecular weight (less than 50) and/or high polar compounds such as, but not limited to the following: Acetaldehyde, Acetic Acid, Acetone, Acetonitrile, Acetylene, Acrolein, Amines, Ammonia, Butadiene, Butane, n-Butane, tert-Butyl Alcohol, Butylene, Carbon dioxide, Carbon monoxide, Dichloromonofluoromethane (Freon 21), Dimethyl sulfide, Ethane, Ether, Ethyl alcohol, Ethyl Chloride, Ethyl formate, Ethyl mercaptan, Ethylene, Ethylene oxide, Formaldehyde, Formic Acid, Freon 11 5, Hexane, Hexene, Hexyne, isopropyl alcohol, Methane, Methyl acetate, Methyl alcohol, Methyl bromide, Methyl chloride, Methyl ether, Methyl formate, Methyl mercaptan, Nitromethane, Pentane, Pentylene, Pentyne, Phosgene, Propionaldehyde, Propane, Triethylamine, Vinyl Chloride.

Previous solvent extraction systems have relied upon distillation, so the solvents had to be very volatile in order to work effectively. Additionally, the solvents had be fairly pure in order to achieve consistent separation from the contaminants. Mixed solvents needed to have similar boiling points and vapor pressures. The use of a molecular sieve/molecular absorbent will allow mixing of various solvents with different boiling points and different vapor pressures, as the dynamics of the molecular sieve/molecular absorbent are not strictly dependent upon vapor pressure and boiling points.

Water, a natural component of soil, is not stopped by the GAC molecular sieve/molecular absorbent, and can be cleaned of organic contaminants along with the extraction solvent. The water in previous solvent extraction systems was typically disposed of with the distillation bottoms. This water disposal is very expensive, and is not necessary when using a molecular sieve/molecular absorbent.

The flow dynamics of GAC and other molecular sieve/molecular absorbents have been researched to reduce channeling and to determine the maximum flow rates of each container configuration. This technical information can be applied to use in solvent extraction without the need for extensive research and development of the flow dynamics of each commercially available system.

The range of molecular sieve/molecular absorbent sizes available on the market offer the opportunity to match the solvent extraction system to be used with the size and contaminant make-up of the site to be processed. A small site can use 55-gallon drum filters, while a larger site may require several 2,000 pound filter systems. The capital costs of a 55 gallon drum are approximately $500.00, and can process a maximum of 10 gallons contaminated solvent per minute (600 gallons per hour). An equivalent distillation system would cost approximately $500,000.00, or 1000 times as much as the molecular sieve/molecular absorbent. Due to the high cost of distillation systems, once a system is constructed, it is rarely upsized or downsized to accommodate a site sizing requirement.

Split systems which use distillation and molecular sieve/molecular absorbents can process very high contaminant levels to very low levels at much lower costs than distillation systems alone. Initially, distillation is used to remove the high contaminant levels from the solvent, which is usually seen in the first few extractions of the soil. The molecular sieve/molecular absorber is then used to process the lower contaminant solvents, which are seen in successive extractions of the soil after the initial flush of higher contamination. During the time the molecular sieve is being used, the distillation system can be working upon the next batch of highly contaminated solvent, thus increasing the output of the system, while not increasing the size of the expensive distillation facility.

Distillation facilities use heat to separate the contaminants from the carrier solvent. With this heat in combination with oxygen, there exists the possibility that unwanted new compounds can be formed. The molecular sieve/molecular absorber uses no heat for separation.

Many of the solvents used in solvent extraction processes are flammable. The use of molecular sieves/molecular absorbers is much safer than using a heat driven process such as distillation.

The concentrated contaminants within a molecular sieve are within a solid matrix, that if spilled will result to less injury to human health and the environment.

Molecular sieves are smaller than distillation systems with equal capacities, so shipment and transport of these systems is less expensive. Molecular sieves/molecular absorbers require little to no maintenance, thus reducing overall costs.

Molecular sieves/molecular absorbers can be operated by persons with little training, thus reducing labor costs.

The availability of molecular sieves/molecular absorbers is such that there is near 24 hour availability. Distillation systems are special order items, and require long lead times for availability.

Using molecular sieves with compressed gasses or gasses near their critical point can alleviate the need for decompression and subsequent recompression of the gasses, resulting in lower operating costs.

Molecular sieves/molecular absorbers can be used to concentrate contaminants that have boiling and vapor pressures similar to the carrier solvent, resulting in increased operating efficiency and cleaner solvent streams than distillation facilities.

Molecular sieves/molecular absorbers can be used to concentrate low contaminant streams into higher contaminant streams by filtration and capture of the contaminants, and then back flushing the molecular sieve/molecular absorber into the distillation facility to further concentrate the contaminant stream. This is a waste volume reduction step, and also reduces greatly the distillation Capacity needed for solvent extraction systems.

In another aspect of the present invention, a method for regenerating spent solvent involves the measurement of water content levels and contaminant levels in the spent solvent. Once obtained, these measurements are used to determine whether the spent solvent is to be processed by distillation or filtration. In the practice of the method of the present invention, the spent solvent (extract) is first monitored, or measured, for its water content level. Depending on whether the content level is above or below a predetermined threshold value (e.g. approximately 50%) the extract will be classified respectively as either a high water level extract or a low water level extract. For a low water level extract, further classification is required according to its contaminant level. Specifically, depending on whether the contaminant level in the low water level extract is above or below a predetermined value (e.g. 100 ppm) the extract will be reclassified respectively as either a high contaminant level extract or a low contaminant level extract. In accordance with the present invention, both the high water level extracts and the high contaminant level extracts will be processed by distillation. On the other hand, the low contaminant level extracts will be regenerated by a relatively less expensive filtration process. In either case, the regenerated solvent is collected and either used for future remediation projects, or recycled and then used for future remediation projects.

Although the description above contains many specificities, these should not be construed as limited the scope of the invention but as merely providing illustrations of some of the presently preferred embodiments of this invention. For example, instead of activated granular carbon, a zeolite sieve could be used, or a synthetic sieve could be used.

Thus the scope of the invention should be determined by the appended claims and their legal equivalents, rather than by the examples given.

What is claimed is:

1. A method for regenerating a solvent from an extract after use in a remediation process, said extract having a variable amount of organic contaminants dissolved in said extract and having a variable water content, which comprises the steps of:

monitoring said water content in said extract to identify a high water level extract when said water content is above a predetermined threshold value and to identify a low water level extract when said water content is below said threshold value;

measuring said amount of organic contaminants in said low water level extract to define a high contaminant extract when said amount of organic contaminants is above a predetermined limit and a low contaminant extract when said amount is below said predetermined limit;

distilling said high water level extract and said high contaminant extract to remove water and organic contaminants therefrom and to yield said solvent;

filtering said low contaminant extract to remove organic contaminants therefrom and to yield said solvent;

collecting said solvent yielded from said distilling step and from said filtering step; and providing said solvent for reuse in said remediation process.

2. A method as recited in claim 1 wherein said monitoring step is accomplished using a hydrometer.

3. A method as recited in claim 2 wherein said predetermined threshold value is approximately fifty percent (50%) water by weight of said extract.

4. A method as recited in claim 1 wherein said measuring step is accomplished with a gas chromatograph.

5. A method as recited in claim 4 wherein said predetermined limit is approximately one hundred parts per million (100 ppm).

6. A method as recited in claim 1 wherein said organic contaminants include polychlorinated bi-phenyls (PCB's) and chlorinated hydrocarbons.

7. A method as recited in claim 1 wherein said filtering step is accomplished with a molecular sieve.

8. A method as recited in claim 7 wherein said molecular sieve is made of an activated granular carbon (AGC) material.

9. A method as recited in claim 7 wherein said molecular sieve is made of a zeolite material.

10. A method as recited in claim 7 wherein said molecular sieve is made of peat moss.

11. A method as recited in claim 7 wherein said molecular sieve is made of synthetic filter sheeting.

12. A method as recited in claim 1 wherein said solvent has a molecular weight approximately sixty grams per mole (60 g/mole).

13. A method as recited in claim 1 further comprising the step of:

repeating said regenerating method with said solvent from said providing step for further purification.

* * * * *